US010508852B2

(12) United States Patent
Yang

(10) Patent No.: US 10,508,852 B2
(45) Date of Patent: Dec. 17, 2019

(54) REFRIGERATOR AND METHOD OF SUPPLYING WATER IN REFRIGERATOR

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 630 days.

(21) Appl. No.: 14/835,633

(22) Filed: Aug. 25, 2015

(65) Prior Publication Data

US 2016/0370063 A1 Dec. 22, 2016

(30) Foreign Application Priority Data

Jun. 17, 2015 (KR) ..... 10-2015-0086164

(51) Int. Cl.

| | |
|---|---|
| ***F25C 1/25*** | (2018.01) |
| ***F24H 9/12*** | (2006.01) |
| ***F24H 1/10*** | (2006.01) |
| ***F25C 5/20*** | (2018.01) |

(52) U.S. Cl.

CPC ..... *F25C 1/25* (2018.01); *F24H 1/101* (2013.01); *F24H 9/128* (2013.01); *F25C 5/22* (2018.01); *F25D 2400/02* (2013.01)

(58) Field of Classification Search

CPC ..... F25C 1/22; F25C 1/225; F25C 1/24–246; F25C 1/04; F25C 1/045; F25C 1/06

See application file for complete search history.

(56) References Cited

U.S. PATENT DOCUMENTS

2005/0279895 A1* 12/2005 Lee ..... A47B 91/04 248/188.8
2013/0263621 A1* 10/2013 An ..... F25C 5/185 62/344
2014/0165623 A1* 6/2014 Guarino ..... F25C 1/24 62/72

FOREIGN PATENT DOCUMENTS

KR 10-2003-0023790 A 3/2003
KR 10-2005-0028226 3/2005
KR 10-2005-0041252 A 5/2005

* cited by examiner

*Primary Examiner* — Ana M Vazquez

(57) ABSTRACT

According to an embodiment, a refrigerator, comprising: a main body comprising a food storage space; a door installed in the main body and configured to open and close the food storage space; and an ice-making device installed in the food storage space, wherein the ice-making device comprises a case comprising a cooling space defined therein, a cooling unit configured to cool the cooling space, and an ice-making system disposed in the cooling space and configured to produce ice pieces, the ice-making system comprising an ice tray comprising a plurality of ice-making spaces capable of retaining water, and a water supply unit configured to supply water to the ice-making spaces, the water supply unit comprises a feeder pipe configured to feed water to the ice-making system, and a water supply pipe connected to the feeder pipe and disposed above the ice tray to extend along a length direction of the ice tray, and a plurality of water supply holes is formed in the water supply pipe in the positions corresponding to the ice-making spaces so that water is supplied to the respective ice-making spaces through the respective water supply holes.

8 Claims, 6 Drawing Sheets

REFRIGERATOR AND METHOD OF SUPPLYING WATER IN REFRIGERATOR

RELATED APPLICATION

This application is based on and claims priority from Korean Patent Application No. 10-2015-0086164, filed on Jun. 17, 2015 for inventor Sung Jin Yang. The disclosure of this application is incorporated herein in its entirety by reference.

FIELD

The present disclosure relates to a refrigerator and a method of supplying water in a refrigerator.

BACKGROUND

A refrigerator is an apparatus for use in storing food at a low temperature and may be configured to store food in a frozen state or a refrigerated state depending on the kind of food to be stored.

The interior of the refrigerator is cooled by continuously-supplied cold air. The cold air is continuously generated by a heat exchange action of a refrigerant according to a refrigeration cycle consisting of compression, condensation, expansion and evaporation. The temperature of the cold air supplied into the refrigerator is uniformly transferred to the interior of the refrigerator by virtue of convection. Thus, the food existing within the refrigerator can be stored at a desired temperature.

In general, the refrigerator includes a main body comprising a rectangular parallelepiped shape with a front surface thereof opened. A refrigerating compartment and a freezing compartment may be provided within the main body. A refrigerating compartment door and a freezing compartment door for selectively closing opening portions may be provided on the front surface of the main body. A plurality of drawers, shelves and container boxes for storing different kinds of food in an optimal state may be provided in the internal storage spaces of the refrigerator.

Adjustable legs which support the main body in the positions between the main body and the body installation floor surface may be provided under the main body of the refrigerator. The height of the main body from the floor surface may be adjusted by adjusting the length of the adjustable legs. In this case, the adjustable legs may lift up the front end portion of the main body so that the front end portion of the main body is positioned higher than the rear end portion of the main body. As a result, the main body is inclined downward from the front end portion toward the rear end portion thereof. If the refrigerator is installed in such a state, it is possible to provide a convenience in that, even if a user does not push an open door backward, the door is self-rotated backward and automatically closes.

Conventionally, top-mount-type refrigerators each comprising a freezing compartment positioned at the upper side and a refrigerating compartment positioned at the lower side constitute the mainstream of refrigerators. In recent years, however, there are commercially available bottom-freezer-type refrigerators in which a freezing compartment is positioned at the lower side in order to enhance the user convenience. In the case of the bottom-freezer-type refrigerators, the frequently-used refrigerating compartment is positioned at the upper side and the freezing compartment used less frequently is positioned at the lower side. This provides an advantage in that a user can conveniently use the refrigerating compartment. However, in the bottom-freezer-type refrigerators, the freezing compartment is positioned at the lower side. This poses an inconvenience in that a user bends at the waist to open the freezing compartment door and to take out ice.

In order to solve such a problem, in recent years, there is commercially available a refrigerator in which a dispenser for dispensing ice is installed in a refrigerating compartment door positioned at the upper side of a bottom-freezer-type refrigerator. In this refrigerator, an ice-making device for making ice may be provided in the refrigerating compartment door or the interior of the refrigerating compartment.

The ice-making device may include an ice-making system provided with an ice tray for producing ice, an ice bucket which stores the ice thus produced, and a feeder system which feeds the ice stored in the ice bucket to the dispenser.

FIG. 1 is a view illustrating an ice tray provided in a conventional ice-making device. Referring to FIG. 1, in a conventional ice tray 30, a plurality of ice-making spaces 33 capable of retaining water and a plurality of partition walls 32 for defining the ice-making spaces 33 are formed on the upper surface of a tray body 31. A water supply port 35 capable of supplying water to the ice-making spaces 33 is formed on one surface of the tray body 31. Water supply grooves 32*a* are formed in the partition walls 32. Thus, the ice-making spaces 33 are coupled to one another. Accordingly, water supplied through the water supply port 35 fills one of the ice-making spaces 33 and moves to the next ice-making space 33 through one of the water supply grooves 32*a*. As a result, water sequentially fills the ice-making spaces 33.

Since the main body of a conventional refrigerator is inclined at a predetermined angle with respect to the floor surface, the ice tray is also inclined at a predetermined angle. Thus, water cannot smoothly move through the water supply grooves of the ice tray. This poses a problem in that the water settling to the ice tray is not uniformly distributed.

SUMMARY

The present disclosure provides a refrigerator capable of allowing water to be uniformly distributed in an ice tray of an ice-making device.

Furthermore, the present disclosure provides a method of supplying water in a refrigerator, which is capable of uniformly distributing water to an ice tray of an ice-making device.

According to an embodiment of the present invention, a refrigerator may comprise: a main body comprising a food storage space; a door installed in the main body and configured to open and close the food storage space; and an ice-making device installed in the food storage space, wherein the ice-making device comprises a case comprising a cooling space defined therein, a cooling unit configured to cool the cooling space, and an ice-making system disposed in the cooling space and configured to produce ice, the ice-making system comprising an ice tray comprising a plurality of ice-making spaces capable of retaining water, and a water supply unit configured to supply water to the ice-making spaces, the water supply unit comprises a feeder pipe configured to feed water to the ice-making system, and a water supply pipe connected to the feeder pipe and disposed above the ice tray to extend along a length direction of the ice tray, and a plurality of water supply holes is formed in the water supply pipe in the positions corresponding to the ice-making spaces so that water is supplied to the respective ice-making spaces through the respective water supply holes In addition, the diameter of the water supply holes may be larger as the water supply holes are positioned farther away from the feeder pipe.

Further, a heater configured to heat the water supply pipe may be provided in the water supply pipe in such a fashion as to surround an outer circumference of the water supply pipe.

Further, a waterproof membrane configured to prevent the heater from making contact with water may be provided outside the heater in such a fashion as to surround the heater and the outer circumference of the water supply pipe.

Further, the refrigerator may be obliquely installed on a floor surface at a predetermined angle with respect to the floor surface in a state in which a front end portion of the main body is positioned higher than a rear end portion thereof.

According to an embodiment, a method of supplying water in a refrigerator, the method comprising: installing a water supply pipe above an ice tray comprising a plurality of ice-making spaces capable of retaining water, the water supply pipe extending along a length direction of the ice tray; and supplying water supplied through the water supply pipe to the respective ice-making spaces through a plurality of water supply holes formed along a length direction of the water supply pipe.

In addition, the water supply holes may be formed on a lower surface of the water supply pipe in the positions corresponding to the ice-making spaces.

Further, the diameter of the water supply holes may be larger as the water supply holes are positioned farther away from a feeder pipe.

DETAILED DESCRIPTION

Figure 1:
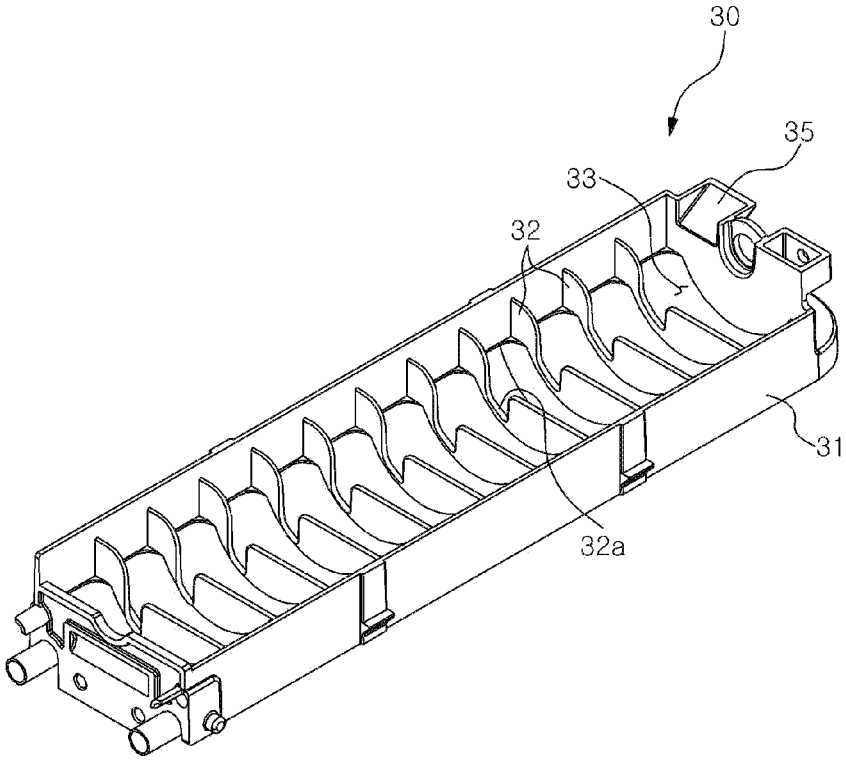
FIG. 1 is a view illustrating an ice tray provided in a conventional ice-making device.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their sizes, and a predetermined size is just exemplificative and not limitative. The same reference numerals designate the same structures, elements, or parts illustrated in two or more drawings in order to exhibit similar characteristics.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
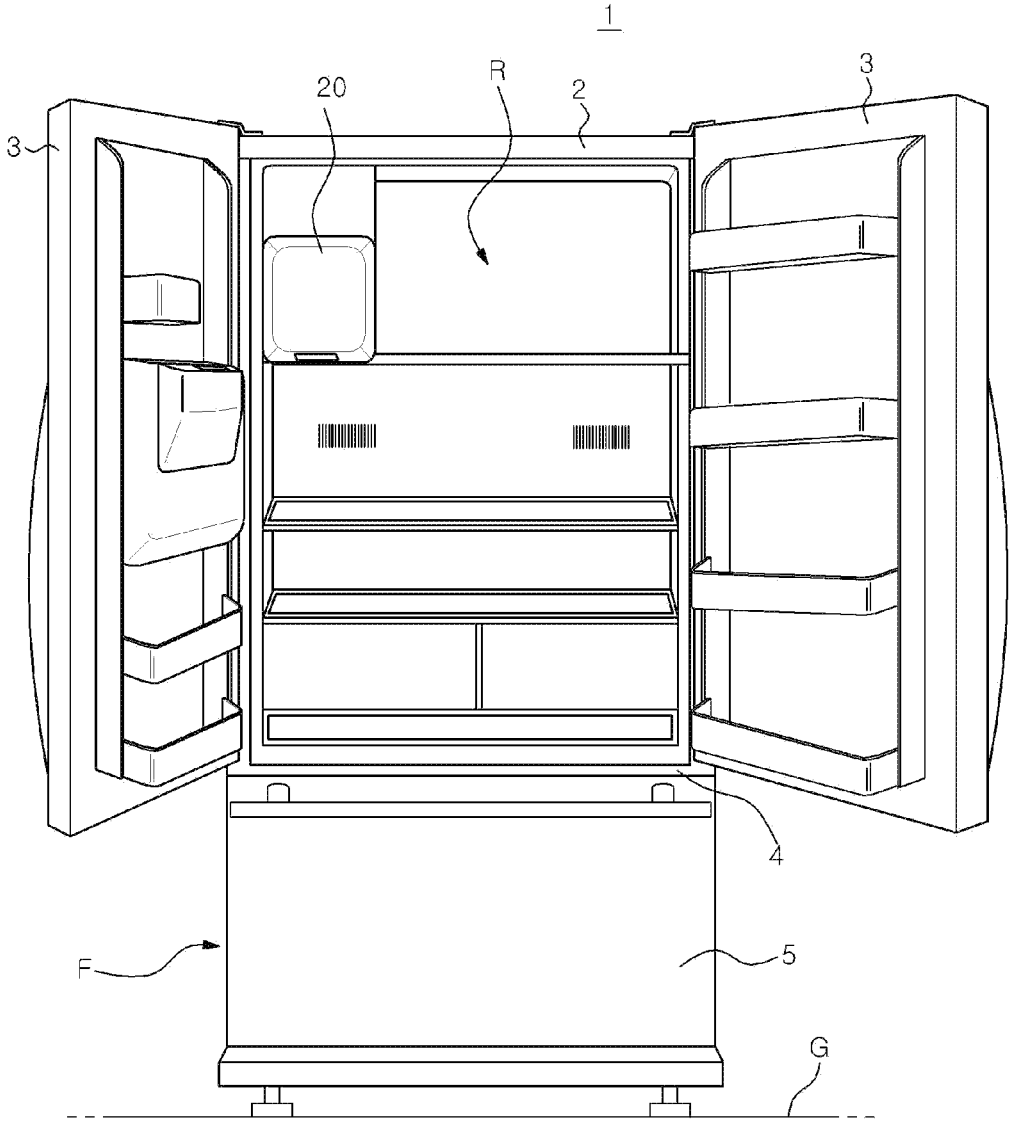
FIG. 2 is a front view of a refrigerator according to one aspect of the present disclosure.
Figure 3:
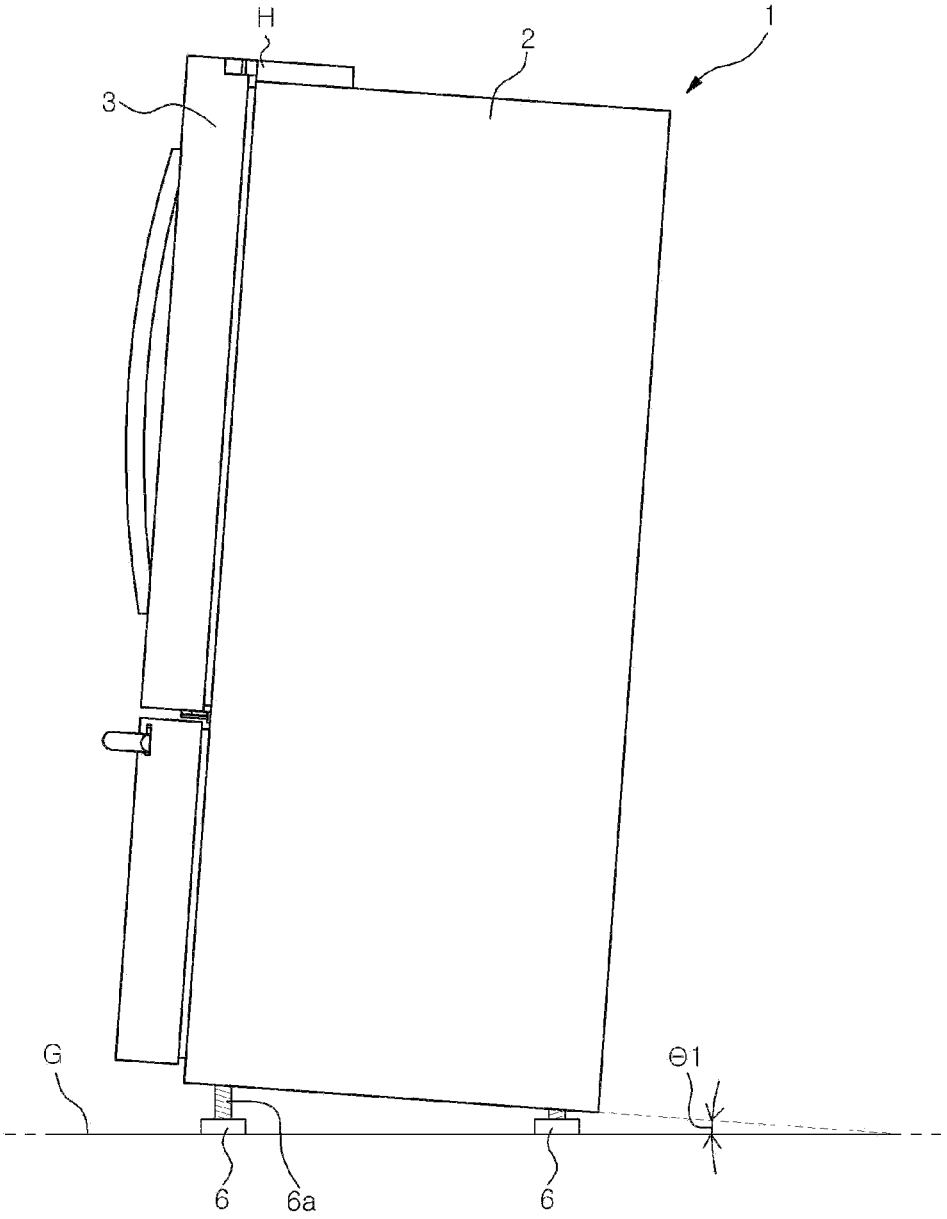
FIG. 3 is a side view illustrating a state in which the refrigerator illustrated in FIG. 2 is obliquely installed with respect to a floor surface with the doors thereof kept closed.

FIG. 2 is a front view of a refrigerator according to one aspect of the present disclosure. FIG. 3 is a side view illustrating a state in which the refrigerator illustrated in FIG. 2 is obliquely installed with respect to a floor surface with the doors thereof kept closed.

Referring to FIGS. 2 and 3, the refrigerator 1 according to the present embodiment may include a main body 2 which comprises an outer shell, a barrier 4 to divide a food storage space formed within the main body 2 into an upper refrigerating compartment R and a lower freezing compartment F, refrigerating compartment doors 3 provided in the opposite edges of the front surface of the main body 2 and configured to selectively close the refrigerating compartment R by the rotational movement thereof, and a freezing compartment door 5 configured to close the front opening portion of the freezing compartment F. In the present embodiment, there is illustrated an example in which an ice-making device 20 is provided in one side region of the upper portion of the refrigerating compartment R. However, this is merely one example. The ice-making device 20 may be located in other positions of the refrigerating compartment R or in one of the refrigerating compartment doors 3.

The main body 2 may be installed on a floor surface G through adjustable legs 6 which can support the main body 2 in the positions between the floor surface G and the main body 2. Each of the adjustable legs 6 may include a height adjusting screw **6*a* whose length of coupling with the bottom surface of the main body 2 is adjustable. The height of the main body 2 from the floor surface G can be adjusted by tightening or loosening the height adjusting screw 6*a*. As illustrated in FIG. 3, the main body 2 may be lifted up by the adjustable legs 6 so that the front end portion of the main body 2 is positioned higher than the rear end portion thereof. As a result, the main body 2 is inclined downward at a predetermined angle θ1 from the front end portion of the main body 2 toward the rear end portion thereof. In this case, even if a user does not push the refrigerating compartment doors 3 after opening the same, the refrigerating compartment doors 3** are rotated backward about hinges H and are automatically closed. This enables a user to conveniently use the refrigerator.

Figure 4:
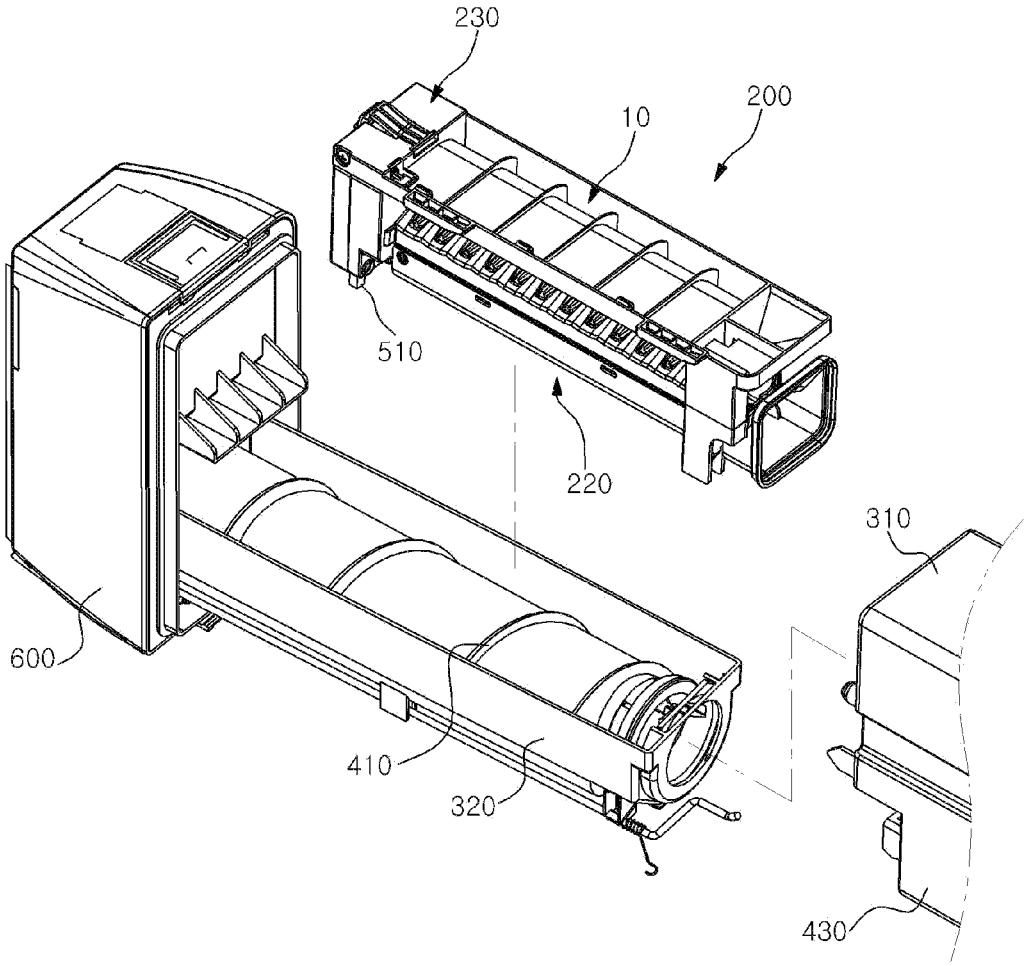
FIG. 4 is an exploded perspective view of an ice-making device provided in the refrigerator illustrated in FIG. 2.
Figure 5:
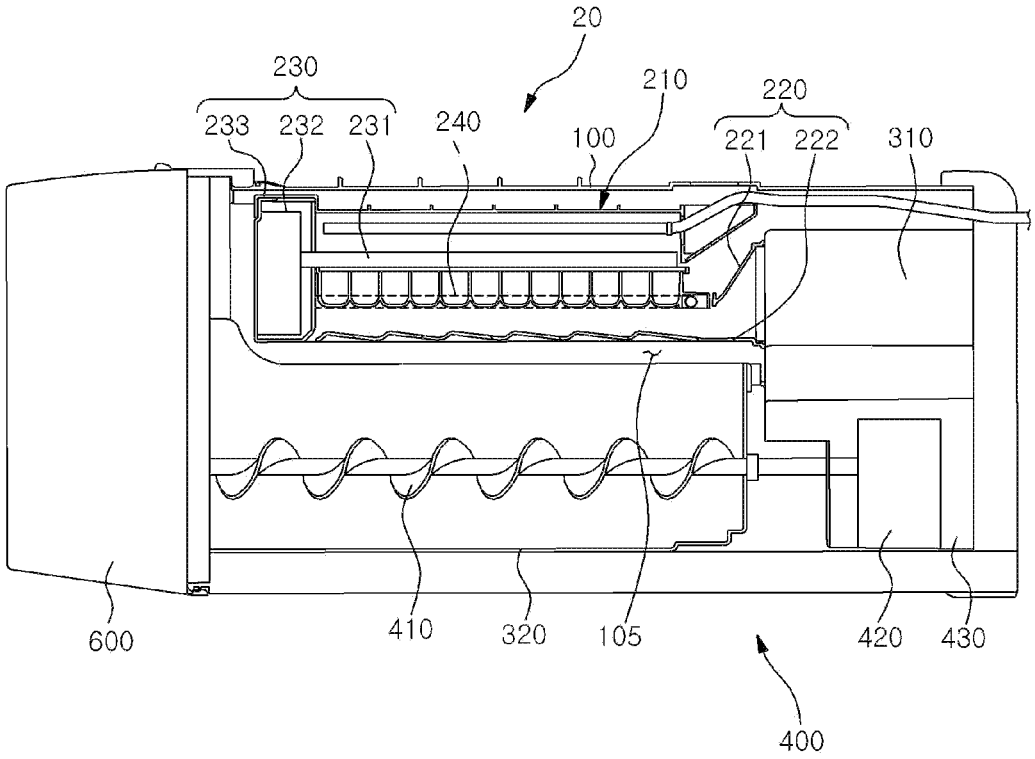
FIG. 5 is a side sectional view of the ice-making device illustrated in FIG. 4.

FIG. 4 is an exploded perspective view of the ice-making device provided in the refrigerator illustrated in FIG. 2, and FIG. 5 is a side sectional view of the ice-making device illustrated in FIG. 4.

Referring to FIGS. 4 and 5, the ice-making device 20 of the refrigerator according to the present embodiment is installed in the storage space of the refrigerator 1 and is capable of uniformly supplying water to ice-making spaces 13 (see FIG. 6) of an ice tray 10. The ice-making device 20 may include a case 100, a cooling unit (not illustrated) configured to cool the interior of the case, an ice-making system 200 to which the ice tray 10 is mounted, an ice bucket 320 in which ice pieces produced in the ice tray 10 are stored, and a feeder system 400 configured to feed the ice cubes from the ice bucket 320.

A cooling space 105 in which ice cubes can be produced is formed within the case 100. The ice-making system 200 may be disposed at the upper side within the cooling space 105.

The cooling unit serves to cool the cooling space 105. The cooling unit can cool the ice tray 10 by generating cold air and supplying it to the ice-making system 200, or by bringing a cooling pipe, which feeds a low-temperature refrigerant, into contact with the lower side of the ice tray 10. The cooling unit may include a compressor, a condenser, an expansion valve and an evaporator, to form a cooling cycle. The cold air may be supplied by a blower or the like to the ice tray 10 via an ejection duct 310 and a cold air guide unit 220.

In the present embodiment, descriptions will be made on an example in which the cold air is supplied to the cooling space 105.

The ice-making system 200 may include an ice tray 10, a water supply unit 210 configured to supply water to the ice tray 10, a cold air guide unit 220 configured to guide the flow of the cold air so that the cold air supplied from the cooling unit moves along the lower surface of the ice tray 10, and a rotary unit 230 configured to drop the ice cubes produced in the ice tray 10 into the ice bucket 320 located below the ice tray 10.

Figure 6:
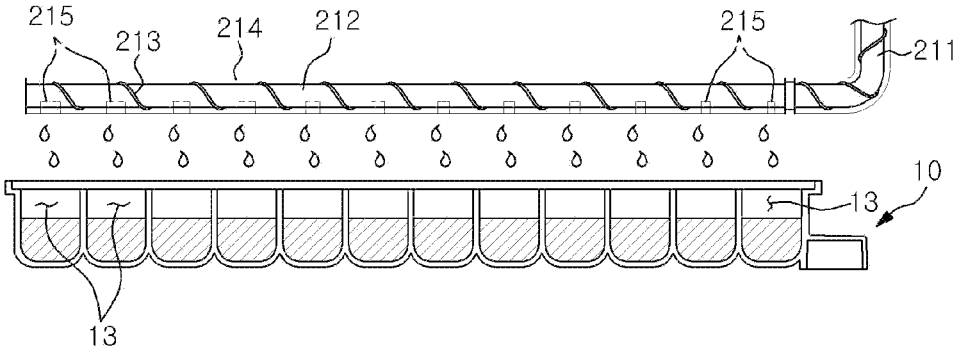
FIG. 6 is a view for explaining a structure by which water is supplied to an ice tray of the ice-making device illustrated in FIG. 5.

FIG. 6 is a view illustrating a structure by which water is supplied to the ice tray of the ice-making device illustrated in FIG. 5.

Referring to FIG. 6, the water supply unit 210 is configured to supply water to the ice tray 10. The water supply unit 210 may include a feeder pipe 211 connected to a water supply tank, a tap water pipeline or the like and configured to feed water to the ice-making system 200, and a water supply pipe 212 connected to the feeder pipe 211 and disposed above the ice tray 10 to extend along the length direction of the ice tray 10. A plurality of water supply holes 215 is formed in the water supply pipe 212 in the positions corresponding to the ice-making spaces 13 so that water can be supplied to the ice-making spaces 13 through the water supply holes 215.

A heater 213 for preventing freezing and rupturing of the feeder 211 and water supply pipes 212 may be provided in the feeder pipe 211 and workpiece in such a fashion that the heater 213 surrounds the outer circumference of the feeder 211 and water supply pipes 212. Furthermore, a waterproof membrane 214 is provided outside the heater 213 in such as fashion as to surround the outer circumference of the feeder 211 and water supply pipes 212. This makes it possible to isolate the heater 213 from moisture, thereby preventing an accident such as a short circuit or the like.

Moreover, the diameter of the water supply holes 215 may be set to be larger as the water supply holes 215 are positioned farther away from the feeder pipe 211. Water supplied through the feeder pipe 211 flows along the water supply pipe 212. At this time, the water is first supplied to the water supply holes 215 positioned closer to the feeder pipe 211 and is then supplied to the water supply holes 215 positioned farther from the feeder pipe 211. For that reason, if the water supply holes 215 are equal in diameter to one another, a larger amount of water is supplied to the water supply holes 215 positioned closer to the feeder pipe 211. That is to say, the amount of water supplied to the ice-making spaces 13 of the ice tray 10 may not be uniform.

On the other hand, if the diameter of the water supply holes 215 is set to be larger as the water supply holes 215 are positioned farther away from the feeder pipe 211, the amount of water supplied to the ice-making spaces 13 becomes uniform across all spaces. The diameter of each of the water supply holes 215 may be set in view of the volume of the ice-making spaces 13, the amount and pressure of the water supplied from the feeder 211 and water supply pipes 212, the length of the water supply pipe 212, etc.

The ice tray 10 may be made of metal material comprising high heat conductivity, e.g., aluminum. As the heat conductivity of the ice tray 10 grows higher, it becomes possible for the ice tray 10 to improve the heat exchange rate of the water and the cold air, whereby the ice tray 10 can serve as one kind of heat exchanger. Cooling ribs (not illustrated) for increasing the contact area of the ice tray 10 with the cold air may be provided on the lower surface of the ice tray 10.

The cold air guide unit 220 functions by guiding the cold air supplied from the cooling unit toward the lower side of the ice tray 10. The cold air guide unit 220 may be connected to the ejection duct 310 which is a path through which the cold air is supplied from the cooling unit. The cold air guide unit 220 may include cold air guide membranes 221 and 222 which are connected to at least one surface of the ejection duct 310. As illustrated in FIG. 5, the cold air guide unit 220 may include a first cold air guide membrane 221 extending from the upper surface of the ejection duct 310 and a second cold air guide membrane 222 extending from the lower surface of the ejection duct 310.

The cold air guided by the cold air guide membranes 221 and 222 can move toward the lower surface of the ice tray 10. As the cold air exchanges heat with the ice tray 10, the water retained in the ice tray 10 is phase-transformed into ice cubes.

The rotary unit 230 may include a motor 232, a rotation shaft 231 connected to the ice tray 10 and rotated by the motor 232, and a motor housing 233 configured to accommodate the motor 232 therein.

The ice pieces thus produced may be dropped by the rotary unit 230 into the ice bucket 320 disposed below the ice tray 10. Specifically, by virtue of the rotation of the rotation shaft 231, the ice tray 10 may be rotated so that the upper surface of the ice tray 10 faces toward the ice bucket 320. If the ice tray 10 is rotated at a specific angle or more, the ice tray 10 is twisted by an interference membrane (not illustrated). Due to this twisting action, the ice pieces located in the ice tray 10 may be dropped into the ice bucket 320.

Alternatively, a plurality of ejectors (not illustrated) may be provided along the length direction of the rotation shaft 231. In this case, the ice tray 10 is not rotated and the ice pieces may be taken out from the ice tray 10 by the rotation of the ejectors of the rotation shaft 231.

Furthermore, an ice release heater 240 may be provided in the ice tray 10 so that the ice release heater 240 can heat the ice tray 10 during or prior to the rotation of the rotation shaft 231. By the heating action of the ice release heater 240, the surfaces of the ice pieces accommodated in the ice tray 10 are melted and separated from the ice tray 10.

The feeder system 400 may include an auger 410 and an auger motor 420 which are configured to feed the ice pieces toward an ejection part 600. The auger 410 may be a rotating membrane comprising a screw or a spiral blade. The auger 410 is rotated by the auger motor 420. The auger 410 is disposed within the ice bucket 320. The ice pieces stacked in the ice bucket 320 may be inserted into the groove defined by the screw or the blade and may be fed toward the ejection part 600. The auger motor 420 may be accommodated within an auger motor housing 2 430.

The ejection part 600 may be coupled to a dispenser (not illustrated) provided in one of the refrigerating compartment doors 3. Depending on the user's choice, the ice pieces fed by the feeder system 400 may be dispensed to a user through the dispenser.

Descriptions will now be made on the actions and effects of the refrigerator and the method of supplying water in a refrigerator according to one aspect of the present disclosure.

In the ice-making device 20 according to the present embodiment, water may be uniformly supplied to the ice-making spaces 13 of the ice tray 10 through the water supply unit 210. Specifically, the water supply pipe 212 extending in the length direction of the ice tray 10 is installed above the ice tray 10 comprising the ice-making spaces 13 formed therein. Water fed through the water supply pipe 212 is supplied to the ice-making spaces 13 through the water supply holes 215 disposed along the length direction of the water supply pipe 212.

Water fed through the feeder pipe 211 is moved along the length direction of the water supply pipe 212 and flows through the water supply holes 215 of the water supply pipe 212 into the ice-making spaces 13 disposed below the water supply pipe 212. The diameter of the water supply holes 215 is larger as the water supply holes 215 are positioned farther away from the feeder pipe 211. Therefore, the amount of water supplied within a unit time through the water supply holes 215 positioned farther away from the feeder pipe 211 is more than the amount of water supplied within a unit time through the water supply holes 215 positioned closer to the feeder pipe 211. Thus, advantageously, the amounts of water supplied to the respective ice-making spaces 13 become uniform across all the spaces.

If the water supply is completed by the water supply unit 210, the cold air generated by the actions of the compressor, the condenser, the expansion valve and the evaporator is supplied to the cooling space 105 through the ejection duct 310. The cold air thus supplied may freeze the water contained in the ice tray 10 disposed within the cooling space 105.

The cold air moves along the lower surface of the ice tray 10 and exchanges heat with the lower surface of the ice tray 10, thereby freezing the water contained in the ice tray 10 into ice pieces. Since the heater 213 is provided in the feeder 211 and water supply pipes 212, it is possible to prevent the feeder 211 and water supply pipes 212 from freezing and rupturing due to cold air. Furthermore, the waterproof membrane 214 prevents the heater 213 from making contact with water. It is therefore possible to prevent the occurrence of a short circuit accident.

The surfaces of the ice pieces produced in the ice tray 10 are melted by the heating action of the ice release heater 240. As a result, the ice pieces are easily separated from the ice tray 10. Thereafter, due to the rotation of the rotation shaft 231, the ice pieces are dropped down and are staked in the ice bucket 320.

In the ice-making device 20 according to the present embodiment, water may be supplied to the respective ice-making spaces 13 by the water supply unit 210. Thus, the amounts of water supplied to the respective ice-making spaces 13 become uniform across the spaces. Accordingly, even when the ice tray 10 is provided in the refrigerator 1 obliquely installed at a predetermined angle with respect to the floor surface G by the adjustable legs 6, the amounts of water supplied to the respective ice-making spaces 13 are advantageously made uniform. This is because water is independently supplied to the respective ice-making spaces 13.

Although exemplary embodiments of the refrigerator and the method of supplying water in a refrigerator according to the present disclosure have been described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator, comprising:

a main body comprising a food storage space;

a door installed in the main body and configured to open and close the food storage space;

an ice-making device installed in the food storage space; and feet to obliquely position the refrigerator on a floor surface at a predetermined angle with respect to the floor surface in a state in which a front end portion of the main body is positioned higher than a rear end portion thereof, wherein the ice-making device comprises:

a case comprising a cooling space defined therein;

a cooling unit configured to cool the cooling space; and an ice-making system located in the cooling space and configured to produce ice pieces, the ice-making system comprising an ice tray comprising:

a plurality of ice-making spaces for retaining water; and a water supply unit configured to supply water to the ice-making spaces, wherein the water supply unit comprises:

a feeder pipe configured to feed water to the ice-making system; and a water supply pipe connected to the feeder pipe and disposed above the ice tray to extend along a length direction of the ice tray; and a heater configured to heat the water supply pipe and the feeder pipe and that surrounds an outer circumference of the water supply pipe and an outer circumference of the feeder pipe;

the water supply pipe comprising a plurality of holes in the positions corresponding to the ice-making spaces wherein water is supplied to the respective ice-making spaces through the respective holes, wherein the diameters of the plurality of holes are larger as the holes are positioned farther away from the feeder pipe, and wherein the plurality of holes is formed on a lower surface of the water supply pipe in positions corresponding to the ice-making spaces.

2. The refrigerator of claim 1 further comprising a waterproof membrane configured to prevent the heater from making contact with water and disposed outside the heater to surround the heater, the outer circumference of the water supply pipe, and the outer circumference of the feeder pipe.

3. The refrigerator of claim 1, wherein the water supply pipe extends along an entire length of the ice tray.

4. The refrigerator of claim 1, wherein the water supply pipe is directly connected to the feeder pipe, wherein the water fed through the feeder pipe is moved along the length direction of the water supply pipe and flows through the holes of the water supply pipe into the ice-making spaces disposed below the water supply pipe, supplying uniform amounts of water to each of the ice-making spaces when the refrigerator is obliquely at an angle with respect to the floor surface.

5. A refrigerator, comprising:

a main body comprising a food storage space;

a door configured to open and close the food storage space;

an ice-making device comprising:

a case comprising a cooling space defined therein;

a cooling unit configured to cool the cooling space; and an ice-making system disposed in the cooling space and configured to produce ice pieces, the ice-making system comprising an ice tray comprising:

a plurality of ice-making spaces for retaining water; and a water supply unit configured to supply water to the ice-making spaces; and feet to obliquely position the refrigerator on a floor surface at a predetermined angle with respect to the floor surface in a state in which a front end portion of the main body is positioned higher than a rear end portion thereof, wherein the water supply unit comprises:

a first pipe configured to supply water to the ice-making system;

a second pipe connected to the first pipe and disposed above the ice tray to extend along a length direction of the ice tray;

a heater configured to heat the first pipe and the second pipe and that surrounds an outer circumference of the first pipe and an outer circumference of the second pipe; and a plurality of holes formed in the second pipe in positions corresponding to the ice-making spaces wherein water is supplied to the ice-making spaces through the plurality of holes, wherein diameters of the plurality of holes are larger as the holes are positioned farther away from the first pipe, and wherein the plurality of holes is formed on a lower surface of the second pipe in positions corresponding to the ice-making spaces.

6. The refrigerator of claim 5, further comprising a waterproof membrane configured to prevent the heater from making contact with water and disposed outside the heater to surround the heater, the outer circumference of the first pipe, and the outer circumference of the second pipe.

7. The refrigerator of claim 5, wherein the second pipe extends along an entire length of the ice tray.

8. The refrigerator of claim 5, wherein the second pipe is directly connected to the first pipe, wherein the water fed through the first pipe is moved along the length direction of the second pipe and flows through the holes of the second pipe into the ice-making spaces disposed below the water supply pipe, supplying uniform amounts of water to each of the ice-making spaces when the refrigerator is obliquely installed at an angle with respect to the floor surface.

* * * * *